US006062760A

United States Patent [19]

Whaley

[11] Patent Number: 6,062,760

[45] Date of Patent: May 16, 2000

[54] MODULAR BINDER RING CONSTRUCTION

[75] Inventor: Paul Whaley, Jefferson Country, Mo.

[73] Assignee: U.S. Ring Binder Corp., New Bedford, Mass.

[21] Appl. No.: 09/008,718

[22] Filed: Jan. 19, 1998

[51] Int. Cl.[7] ..... B42F 3/04

[52] U.S. Cl. ..... 402/26; 402/30; 402/34; 402/38; 402/32; 402/36; 402/33

[58] Field of Search ..... 402/26, 28, 29, 402/30, 31, 32, 33, 34, 35, 36, 37, 38, 60, 70, 73, 80 R

[56] References Cited

U.S. PATENT DOCUMENTS

| | | | |
|---|---|---|---|
| 831,969 | 9/1906 | Morden et al. | 402/32 |
| 908,597 | 1/1909 | Morden | 402/32 |
| 973,452 | 10/1910 | Morden et al. | 402/32 |
| 973,932 | 10/1910 | Fornoff et al. | 402/32 |
| 1,000,649 | 9/1911 | Walker, Jr. . | |
| 1,111,377 | 9/1914 | Goss | 402/32 |
| 1,231,816 | 7/1917 | Vesterling | 402/32 |
| 1,472,301 | 10/1923 | Koepsell | 402/33 |
| 1,652,521 | 12/1927 | Eifel | 402/33 |
| 2,073,049 | 3/1937 | Dawson | 402/33 |
| 2,322,595 | 1/1943 | Schade | 402/31 |
| 2,543,866 | 3/1951 | Panfil . | |
| 3,132,649 | 5/1964 | Gits | 402/38 |
| 3,270,749 | 9/1966 | O'Connel | 402/36 |
| 3,785,740 | 1/1974 | Strong | 402/29 |
| 4,854,763 | 8/1989 | Jonson | 402/31 |
| 5,116,081 | 5/1992 | Mann, Jr. | 402/73 |
| 5,611,633 | 3/1997 | Whaley | 402/73 |
| 5,692,847 | 12/1997 | Zane et al. | 402/38 |
| 5,810,500 | 9/1998 | Whaley | 402/31 |

*Primary Examiner*—Andrea L. Pitts
*Assistant Examiner*—Alisa L. Thurston
*Attorney, Agent, or Firm*—Polster, Lieder, Woodruff, & Lucchesi L.C.

[57] ABSTRACT

A modular binder ring unit (16) used in a ring binder (10) comprises a plurality of modules including a binder ring module (18). The modules are spaced along the length of the unit. A plurality of spacer modules (22, 24, 30) attach to the ring modules. The spacer modules are available in different lengths, and a combination of different length modules are usable together with the ring modules to form a binder ring unit of a desired length. The spacer modules space the ring modules an appropriate distance apart for the binder rings to be at locations corresponding to holes (H) in a sheet of paper (S) stored in the binder. End caps (26) are removably attachable at each end of said unit for locking the ring modules and spacer modules in place. Each module element is an elongate module having a recess (R) formed in one end and an extension (E) at the opposite end for securing one module to an adjacent module. Each extension is sized to fit in the recess formed in the adjacent module to which the one module is secured.

28 Claims, 5 Drawing Sheets

MODULAR BINDER RING CONSTRUCTION

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

This invention relates to binders for holding paper and the like, and more particularly, to a modular ring binder construction by which binder ring portion of the binder can be made for different size binders using a single set of common modular components.

Conventional ring binders have a central portion generally referred to as a "ring metal" or "metal". This unit is typically a single piece stamping to which two-piece binder rings, end levers, and hinged lever elements are attached. A completed metal is then affixed to the spine portion of a binder using rivets or the like. Paper or similar hole punched materials are then stored in the binder by opening the rings, capturing the paper on one of the ring segments, and then closing the ring.

Because of the number of different types of binders which are used, there has not been a standard metal which is usable with more than one or two different binders. Not only is this because of size, but also because some binders are used with paper in which two holes are punched, some with three holes, and some with four holes or more. As a result, binder makers are required to have available a substantial inventory of different ring metals. It would be particularly advantageous if a manufacturer were able to produce a substantial number of different size metals from a small number of interchangeable parts. These parts would include binder rings and would allow for any number of binder rings to be used in manufacturer of the part.

BRIEF SUMMARY OF THE INVENTION

Among the several objects of the present invention may be noted the provision of a binder for holding hole punched sheets of paper or the like, and a binder ring unit usable with the binder;

- the provision of such a binder ring unit which is of a modular construction;
- the provision of such a binder ring unit which is formed of standard modules, one type of module being for binder rings; and a second type module being a spacer module used to separate the binder rings so they are located at positions corresponding to the holes punched in a sheet of paper or the like;
- the provision of such a binder ring unit in which the spacer modules are available in different lengths, the modules being combinable in any desired combination to produce a particular unit;
- the provision of such a binder ring unit in which all of the modules have standard, interfitting end constructions so any one type of module is readily attachable to any other module;
- the provision of such a binder ring unit in which each modules has two sections which are joined together in a side-by-side arrangement and in which one section is pivotally rotatable with respect to the other, so to enable the unit to be opened and closed to store and remove paper;

- the provision of such a binder ring unit to further include end caps fitting over each end of the unit to lock all of the modules together;
- the provision of such a binder ring unit binder ring unit in which the modules are each formed of a plastic material for the units to be lightweight;
- the provision of such a binder ring unit construction which, because of the commonality of parts which can be used to assemble a wide variety of units produces substantial cost savings to the manufacturer;
- the provision of such a binder ring unit in which the modules are available in different colors so different units can be created to each have a different appearance; and,
- the provision of such a binder ring unit in which the modules provide a manufacturer a great deal of flexibility in the manufacture of a ring binder for different customers.

In accordance with the invention, generally stated, a modular binder ring unit used in a ring binder comprises a plurality of modules including a binder ring module. The modules are spaced along the length of the unit. A plurality of spacer modules attach to the ring modules, and the spacer modules are available in different lengths. A combination of different length spacer modules are usable together with the ring modules to form a binder ring unit of a particular length. The spacer modules space the ring modules an appropriate distance apart for the binder rings to be at locations corresponding to holes in a sheet of paper stored in the binder. End caps are removably attachable at each end of the unit for locking the ring modules and spacer modules in place. Each module element is an elongate module having a recess formed in one end and an extension at the opposite end for securing one module to an adjacent module. Each extension is sized to fit in the recess formed in the adjacent module to which the one module is secured. Other objects and features will be in part apparent and in part pointed out hereinafter.

BRIEF DESCRIPTION OF THE SEVERAL VIEWS OF THE DRAWINGS

In the drawings.

Corresponding reference characters indicate corresponding parts throughout the drawings.

DETAILED DESCRIPTION OF THE INVENTION

Figure 1:
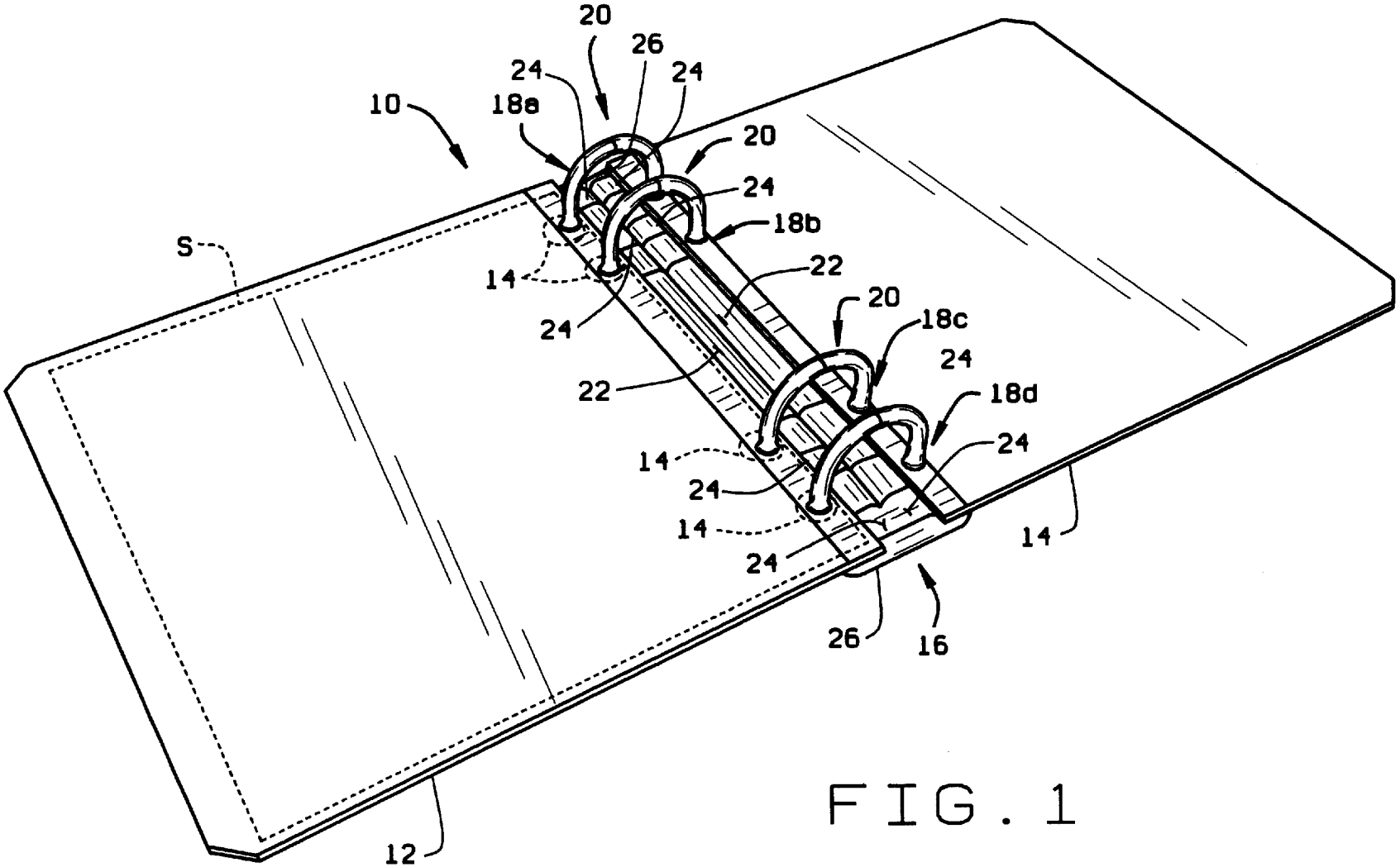
FIG. 1 is a perspective view of a ring binder including a modular binder ring unit of the present invention.

Referring to the drawings, a binder of the present invention is indicated generally 10. The binder is for use in storing sheets S of paper having punched holes H in them. Binder 10 includes first and second end leafs 12, 14 respectively forming outer covers of the binder. The leafs are generally rectangular in shape and may be made of any suitable material. The length and width of the leafs are a function of the size of paper a particular binder 10 is intended to store. Next, a binder ring unit indicated generally 16 is positioned intermediate the respective end leafs, and the inner end of each end leaf is attached to the binder ring unit as described hereinafter. Heretofore, instead of unit 16, a ring metal comprising an elongate or rectangularly shaped metal plate (not shown) has been used with the end leafs attached to the center plate and the center plate, in turn, attached to a spine portion of the binder by rivets or the like.

Now, and as best shown in FIG. 1, binder ring unit 16 is of a modular construction. In particular, unit 16 is formed a plurality of ring modules 18*a*–18*d*, each of which includes a binder ring 20, and a plurality of spacer modules 22, 24 to which the ring modules attach. End caps 26 are removably attachable to the modules positioned at each end of the unit to lock the ring modules 18 and spacer modules 22, 24 in place. As shown in the drawing figures, at least one ring module 18 is used in constructing a unit 16, and the spacer modules are used to space the ring modules an appropriate distance apart so the binder rings 20 are at locations corresponding to the holes H in a sheet S of paper stored in the binder. The modules are preferably made of a plastic or other lightweight material.

Figure 2:
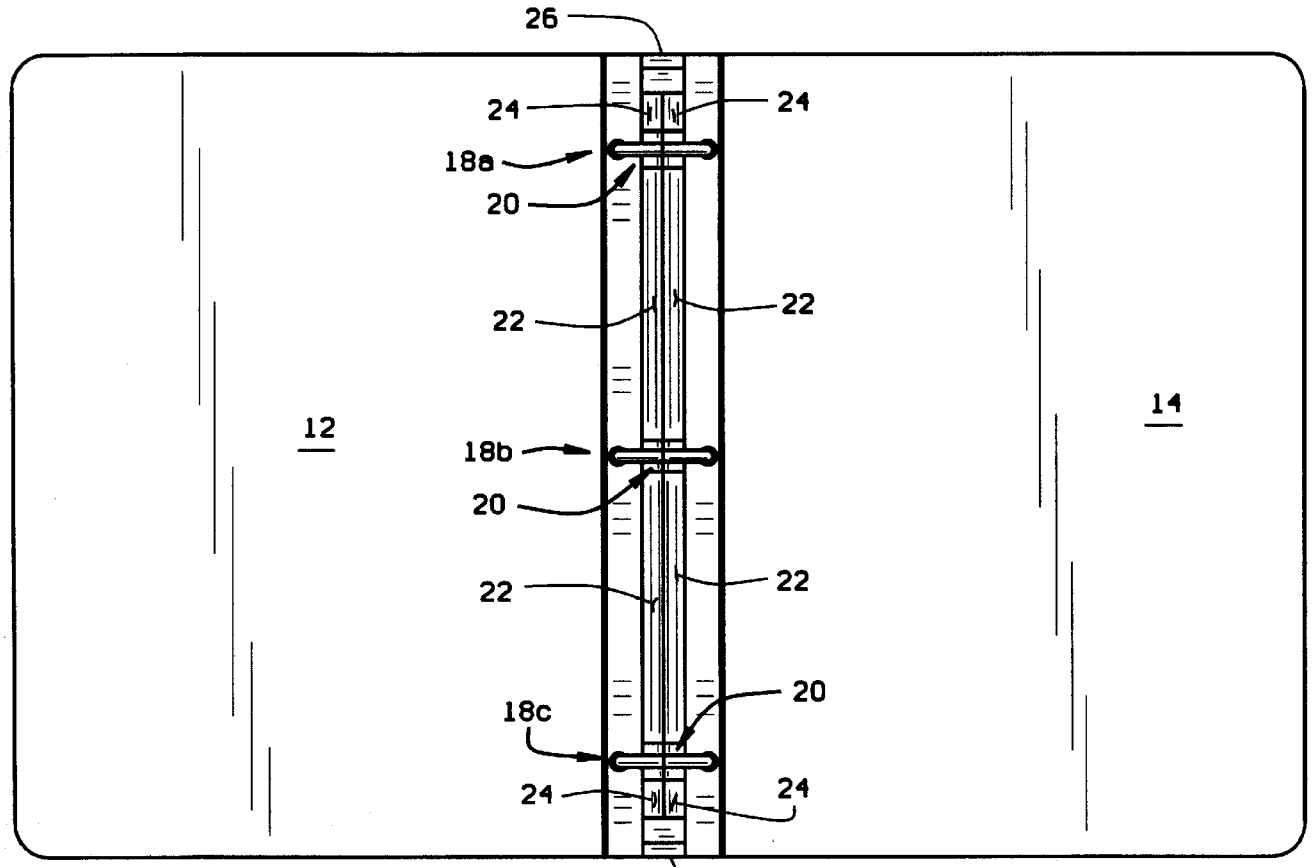
FIG. 2 is a plan view of the ring binder.
Figure 3:
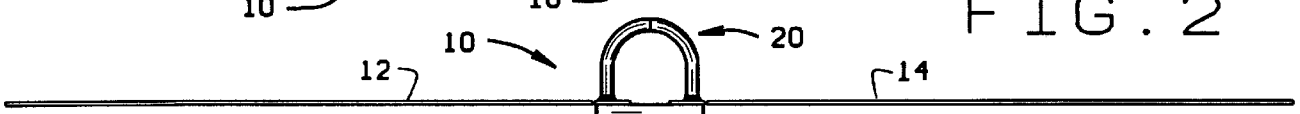
FIG. 3 is an elevational view of the binder.
Figure 4:
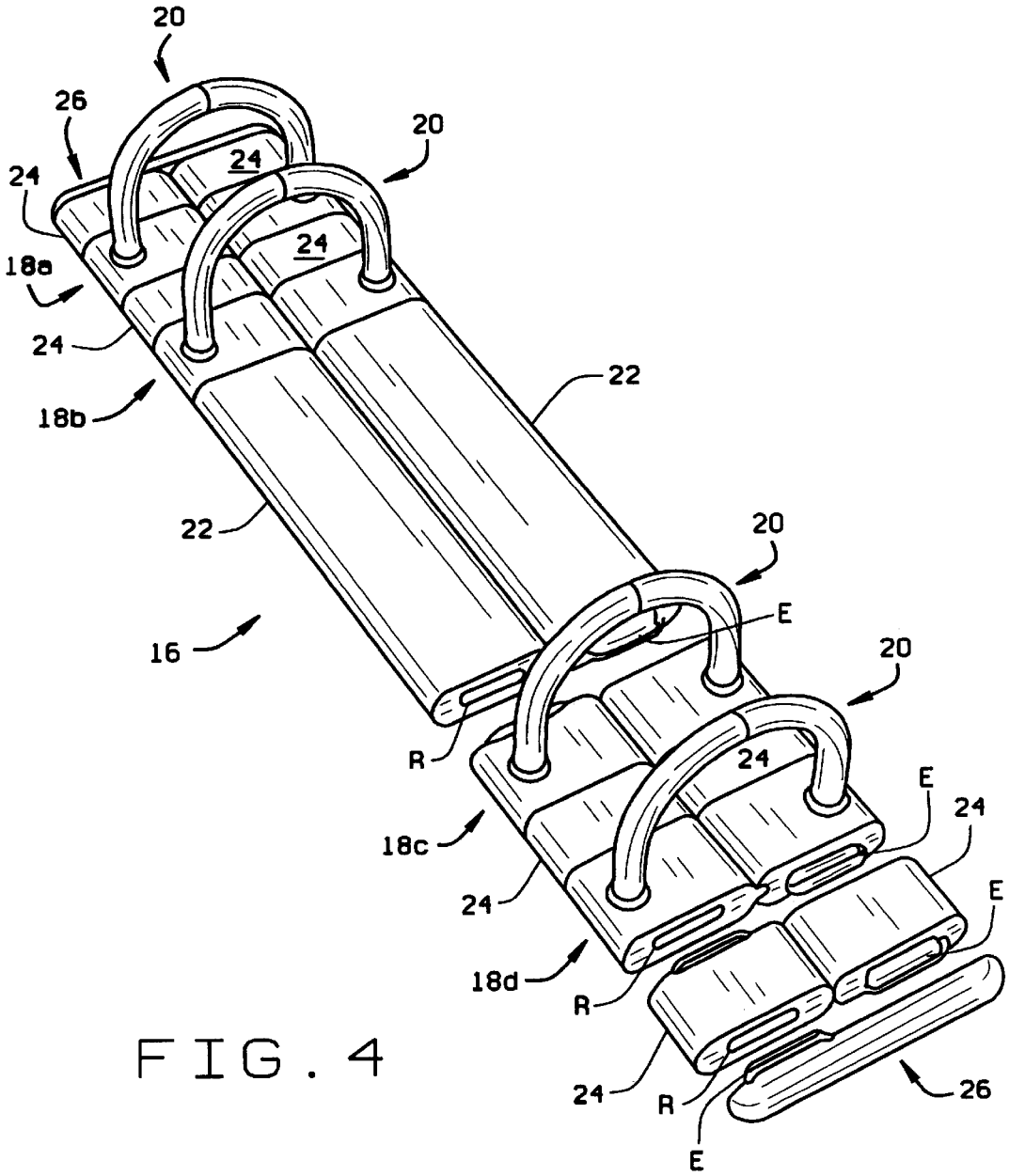
FIG. 4 is a perspective view of spacer modules and binder ring modules forming the binder ring unit in an exploded condition.

It is an important feature of the present invention that the modular elements 18, 22, 24, and 26 shown in the drawings can be used to manufacture a wide variety of binder ring units 16 for use in any number of different types of ring binders. A four ring unit 16 is shown in FIGS. 1 and 4, and a three ring unit in FIG. 2. Although not shown, unit 16 could also be used in a one, two, or five or more ring binder construction as well, without departing from the scope of the invention. In each instance, the modules are arranged side-by-side with the ring modules each comprising two interlocking segments 18A and 18B as described hereinafter. Further, and as shown in FIG. 5, other length spacer modules such as the spacer module 30 can also be used in constructing binder ring unit 10.

Figure 8A:
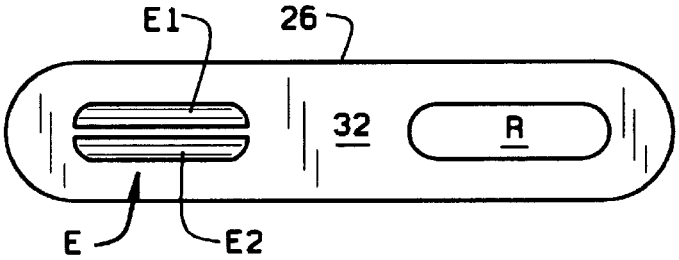
Figure 8B:
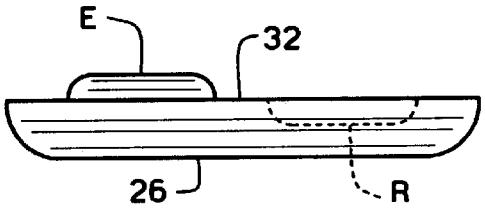

Each module used in making a binder ring unit 16 is an elongate module having a recess R formed in one end and an extension E formed on, and extending from, the opposite end of the module. The recess and extension on all of the modules are identically formed so the various modules are interchangeable with one another. Similarly, end cap 26 has an inner face 32 on which both an extension E and recess R are formed. This extension and recess are arranged side-by-side, since the width of the end cap is such that it spans the side-by-arrangement of other modules. As shown in the drawings, each extension E has a generally rounded contour to facilitate insertion of the extension formed on one module into the recess formed on an adjacent module. Further, each extension is formed to have two segments, E1 and E2 as shown in FIGS. 5 and 8A, which extend parallel to each other transversely of a longitudinal centerline L of a particular module. A slot S separates the upper segment E1 from the lower segment E2. The slot allows each segment to be slightly compressed when the extension is inserted into a particular recess. The resulting friction fit helps insure that the assembly of modules will not come apart during subsequent assembly of a binder and during the binder's use.

Figure 5:
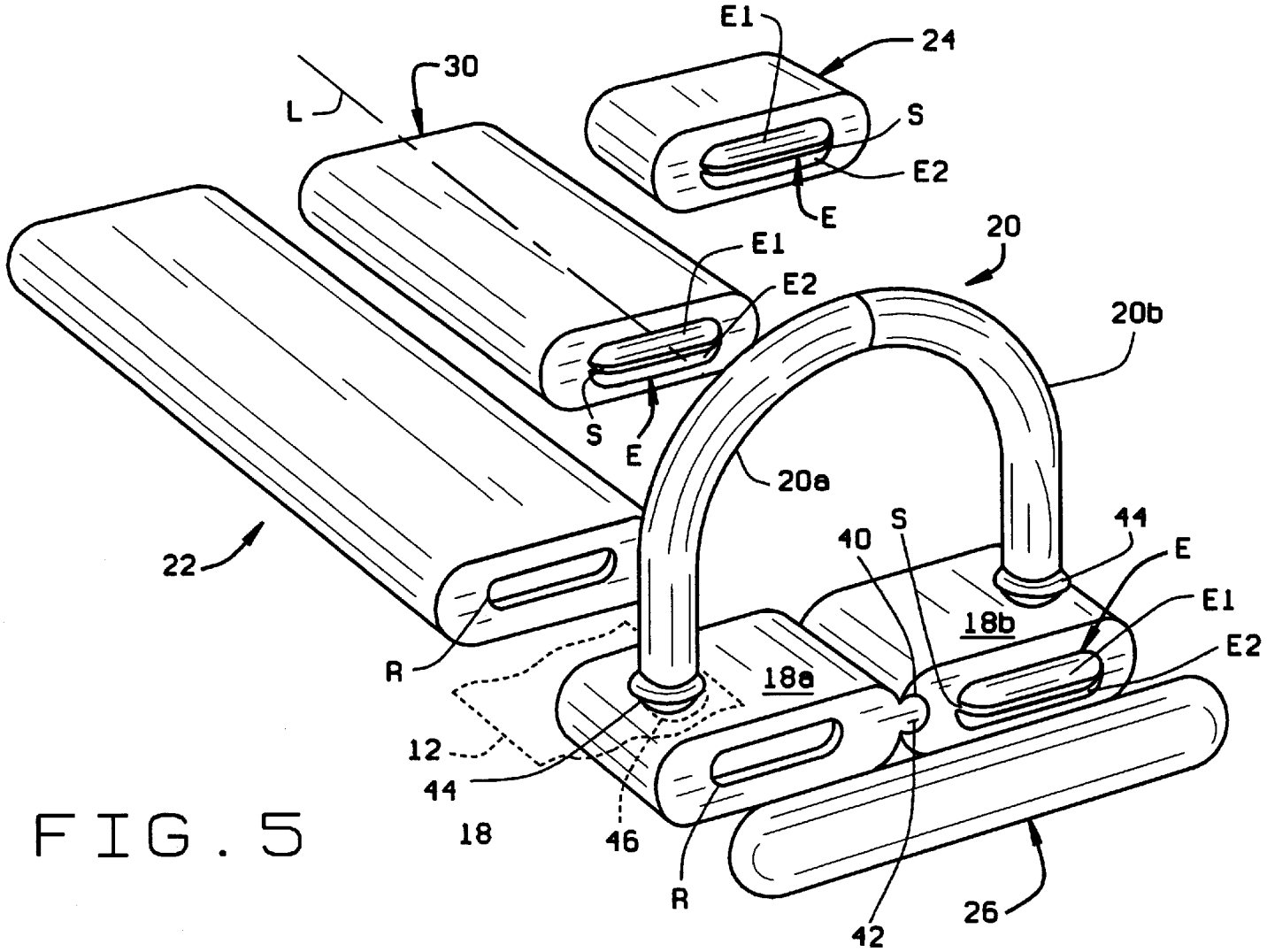
FIG. 5 is another perspective view of the various modules from which a binder ring unit is formed.
Figure 6:
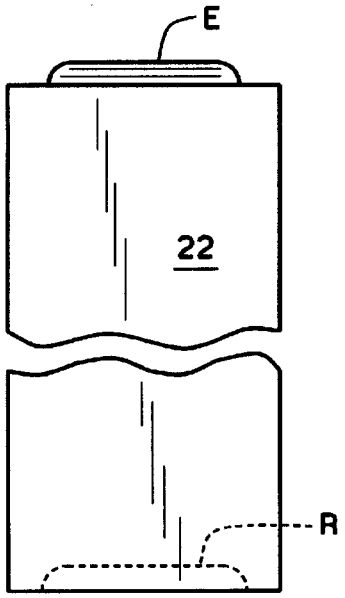
FIG. 6 is a plan view of a spacer module.
Figure 7:
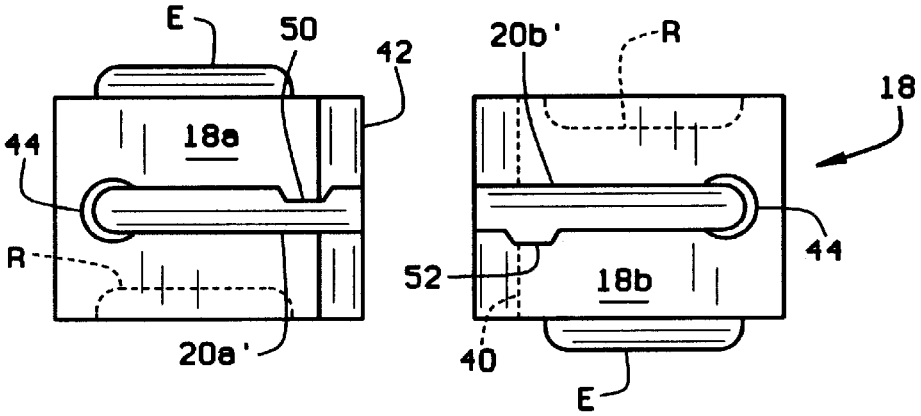
FIG. 7 is a respective plan view of the two sections forming a ring module; and, FIGS. 8A and 8B are respective elevational and plan views of an end cap for a binder ring unit.

As shown in FIGS. 5 and 7, each binder ring module 18 includes a pair of interlocking ring segments 18A, 18B. And, ring 20 includes a pair of interfitting ring sections 20A, 20B with one of the ring sections 20A being formed on one of the segments 18A, and the other ring section 20B being formed on the other ring section 18B. In order to open and close binder 10, the ring module sections 18A, 18B are rotatable relative to each other. This moves the respective ring sections 20A, 20B into and out of their interlocking relationship with each other. As shown in FIG. 5, ring segment 18B has a socket 40 formed in one side thereof. The other ring segment 18A includes a member 42 formed in the side of the member adjacent the side in segment 18B in which socket 49 is formed when the segments are connected together. Member 42 is sized to be removably, rotatably received in socket 40 for attaching segments 18A and 18B together in their side-by-side relationship. In FIG. 7, socket 40 is shown to extend the length of segment 18B, while member 42 is shown to comprise a rod extending the length of segment 18A. It will be understood that other constructions are possible without departing from the scope of the invention. For example, member 42 could be a ball and socket 40 a socket formed to receive the ball. This ball and socket arrangement could be formed at a midpoint of the module, directly in line with the ring sections 20A, 20B. Further, it will be noted that the spacer modules are not interconnected as are the segments forming a ring module 18. Rather, the sides of the spacer modules are rounded as shown in the drawings so that there is a minimum area of surface contact between the spacer modules when arranged side-by-side. When the ring module segments 18A, 18B are rotated, the spacer modules also rotate relative to each other; and do so without the need of one spacer module being interconnected with the spacer module against which it is alongside.

Each section of a binder ring 20 is hard mounted to its associated ring module segment. Thus, the binder ring can only be open or closed by rotating the ring segments 18A, 18B to each other. As shown in FIG. 5, in one embodiment of the binder ring, the sections 20A, 20B are identically formed. Each section has a generally straight shaft extending upwardly from a top surface of the segment. The top of the section then curves inwardly. At the base of each section is a flared section 44. This section is used to capture one of the end leafs 12, 14 onto the modular ring binder unit 16. Each end leaf has a number of holes 46 spaced along the side of the leaf to which unit 16 attaches. The diameter of section 44, at its greatest, is slightly larger than the diameter of the hole 46 in the leaf. Because section 44 is flared, this allows the opening to be guided over the flared and then captured in place between the underside of the section and the top surface of the ring module segment. This is as shown in FIG. 5. Further, and as shown in FIG. 5, the outer ends of ring sections 20A, 20B are flat. This allows the rings sections to abut against each other when binder 10 is closed to keep papers stored in the binder. Alternatively, and as shown in FIG. 7, sections 20A' and 20B' can be made to overlap each other. Now, one of the sections 20A' has a notch 50 formed in it, and the other section 20B' a lug 52 formed to fit in the notch. Now, the two sections interlock with each other when the binder is closed.

When constructing a ring binder unit, a manufacturer can lay out a pattern of modules which best works with the number of binder rings to be used, the overall length or height of the binder, and any particular design features which are to be incorporated. It will be understood by those skilled in the art that the different ring modules, spacer modules, and end units can be of different colors so that bands of color are created by use of different modules. Also, the inner and outer faces of the modules can incorporate a variety of ornamental designs. Such designs would be easy to incorporate if the modules were made of a molded plastic material.

What has been described is a binder for holding hole punched sheets of paper or the like, and a binder ring unit usable with the binder. The binder ring unit is of a modular construction and is formed from standard modules. One type module has binder rings, and a second type module is a spacer module for separating binder rings so they are positioned where the holes punched in a sheet of paper appear. The spacer modules are available in different lengths and the various modules are combinable in any desired combination to produce a particular unit. All of the modules have standard, interfitting end constructions allowing any module to be readily attached to another. Each module has two sections which are joined together side-by-side. One section is pivotally rotatable with respect to the other, and this allows the unit to be easily opened and closed. End caps fit over each end of the unit to lock all of the modules together.

The modules are all formed of a plastic material so the units will be lightweight. Given the commonality of parts, a wide variety of units can be produced at a substantial cost savings to the manufacturer. Also, the modules are available in different colors so different units can be created for each to have a different appearance. Finally; use of the modules provide a manufacturer a great deal of flexibility in the manufacture of a ring binder for different customers.

In view of the foregoing, it will be seen that the several objects of the invention are achieved and other advantageous results are obtained.

As various changes could be made in the above constructions without departing from the scope of the invention, it is intended that all matter contained in the above description or shown in the accompanying drawings shall be interpreted as illustrative and not in a limiting sense.

I claim:

1. A binder for use in storing sheets of paper having punched holes in them, said binder being openable and closeable, comprising:

first and second end leafs respectively forming outer covers of the binder; and, a binder ring unit positioned intermediate said respective end leafs, said binder ring unit being comprised of a plurality of modules arrayed in serie,s at least one end of each of said modules being longitudinally connected to one end of at least one other of said modules, one side of each of said end leafs being attached to opposite sides of said binder ring unit for sheets of paper stored in said binder to be enclosed between said end leafs, and of which at least one of said modules is a ring module including a binder ring for securing a sheet of paper in place in the binder.

2. The binder of claim 1 further including a plurality of ring modules each of which includes a binder ring, said ring modules being longitudinally arrayed, in series, along the length of said binder ring unit.

3. The binder of claim 2 wherein said modules further include spacer modules longitudinally arrayed, in series with said ring modules, said ring modules attaching to said spacer modules, and said spacer modules spacing said ring modules an appropriate distance apart for said binder rings to be at locations corresponding to holes in a sheet of paper stored in the binder.

4. The binder of claim 3 wherein said spacer modules are available in different lengths with a combination of different length spacer modules being usable together with said ring modules to form a binder ring unit of a desired length.

5. The binder of claim 4 wherein each binder ring module includes a pair of interlocking ring segments, each ring segment being formed on one of a pair of ring sections which are attachable together in an opposing relationship.

6. The binder of claim 5 wherein said ring sections are rotatable relative to each other and relative to a central axis of the binder ring unit so as to move the respective ring segments into and out of a closed positional with each other.

7. The binder of claim 6 wherein said spacer modules are each comprised of a pair of spacer sections attachable together in an opposing relationship.

8. The binder of claim 7 wherein said spacer sections are rotatable relative to each other in conjunction with the movement of a ring element so to support movement of said ring sections as said ring segments are moved into and out of a closed positional relationship with each other.

9. The binder of claim 8 wherein said ring modules and said spacer modules are combined together so the overall length of said binder ring unit corresponds to the height of the binder.

10. The binder of claim 4 further including an end cap module removably attachable at each end of said binder ring unit for locking intermediate ring modules and spacer modules in place and for preventing the opening of said ring modules.

11. The binder of claim 4 wherein each module is an elongate module having securing means at each end securing said module to an adjacent module.

12. The binder of claim 11 wherein each module has a recess formed in one end thereof, and an extension extending from an opposite end thereof and sized to fit in a recess formed in said adjacent module to which said one module is secured.

13. The binder of claim 7 wherein one of each pair of said ring sections has a socket formed in one side thereof, and the other section of said pair includes a member formed in one side thereof and sized to be removably, rotatably received in said socket for matingly attaching said modules together in said opposing relationship.

14. The binder of claim 13 wherein said socket extends the length of said one element of said pair and said member comprises a rod extending the length of the other element of said pair.

15. A modular binder ring unit for use in a ring binder comprising:

a plurality of modules arrayed in series, at least one end of each of said modules being longitudinally connected to one end of at least one other of said modules, said modules including:

a plurality of ring modules, each of which includes a binder ring, said ring modules being spaced along the length of said binder ring unit; and, a plurality of spacer modules to which said ring modules attach, said spacer modules spacing said ring modules an appropriate distance apart for said binder rings to be at locations corresponding to holes in a sheet of paper stored in the binder.

16. The modular ring binder unit of claim 15 further including end caps removably attachable at each end of said unit for locking said ring modules and spacer modules in place and for preventing the opening of said ring modules.

17. The modular binder ring unit of claim 15 wherein each module is an elongate module having a recess formed in one end and an extension extending from an opposite end for securing said module to an adjacent module, said extension being sized to fit in a recess formed in said adjacent module to which said one module is secured.

18. The modular binder ring unit of claim 15 wherein said spacer modules are available in different lengths with a combination of different length spacer modules being usable together with said ring modules to form a binder ring unit of a desired length.

19. The modular binder ring unit of claim 18 wherein each binder ring module includes a pair of interlocking ring segments, each ring segment being formed on one of a pair of ring sections which are attachable together in an opposing relationship.

20. The modular binder ring unit of claim 19 wherein said ring sections are rotatable relative to each other and relative to the central axis of the modular binder ring unit to move the respective ring segments into and out of a closed positional relationship with each other.

21. The modular binder ring unit of claim 20 wherein said spacer modules are each comprised of a pair of spacer sections attachable together in an opposing relationship, and rotatable relative to each other in conjunction with the movement of a ring module so as to support movement of said ring sections as said ring segments are moved into and out of a closed positional relationship with each other.

22. The modular binder ring unit of claim 21 wherein one of each pair of said ring sections has a socket formed in one side thereof, and the other section of said pair includes a member formed in one side thereof and sized to be removably, rotatably received in said socket for matingly attaching said modules together in said opposing relationship.

23. The modular binder ring unit of claim 22 wherein said socket extends the length of said one element of said pair and said member comprises a rod extending the length of the other element of said pair.

24. The modular binder ring unit of claim 15 wherein said ring modules and spacer modules are each formed of a plastic material.

25. A method of forming a binder ring unit for a ring binder comprising:

longitudinally arranging a plurality of ring modules, each of which includes a binder ring, in a spaced relationship along the length of said unit;

arranging between said ring modules at least one spacer module to which said ring modules attach, said spacer modules spacing said ring modules an appropriate distance apart for said binder rings to be at locations corresponding to said holes in a sheet of paper stored in the binder; and, attaching adjacent ring modules and spacer modules together so that at least one end of each of said ring modules and spacer modules is longitudinally connected to one end of at least one other of said ring or spacer modules.

26. The method of claim 25 further including forming each ring module and spacer module with a recess at one end and an extension at the opposite end, said extension being sized to fit in a recess formed in an adjacent module to which a longitudinally adjacent module may be secured.

27. The method of claim 26 further including attaching end caps to an outer end of each module at an outer end of said unit to lock said ring modules and spacer modules in place.

28. The method of claim 25 wherein said spacer modules are available in different lengths with a combination of different length spacer modules being usable together with said ring modules to form a binder ring unit of a desired length.

* * * * *